US007715580B2

(12) United States Patent
Nielsen

(10) Patent No.: US 7,715,580 B2
(45) Date of Patent: May 11, 2010

(54) INTERCHANGEABLE ATTACHMENT MEANS FOR ATTACHING A CONDUCTOR TO A HEARING AID

(75) Inventor: Dennis Brian Nielsen, Helsinge (DK)

(73) Assignee: Widex A/S, Vaerlose (DK)

( * ) Notice: Subject to any disclaimer, the term of this patent is extended or adjusted under 35 U.S.C. 154(b) by 27 days.

(21) Appl. No.: 10/573,752

(22) PCT Filed: Mar. 21, 2006

(86) PCT No.: PCT/DK2006/000159

§ 371 (c)(1),
(2), (4) Date: Jan. 25, 2007

(87) PCT Pub. No.: WO2007/107154

PCT Pub. Date: Sep. 27, 2007

(65) Prior Publication Data

US 2007/0223756 A1 Sep. 27, 2007

(51) Int. Cl.
*H04R 25/00* (2006.01)

(52) U.S. Cl. ..... 381/322; 381/330

(58) Field of Classification Search ..... 381/322, 381/330

See application file for complete search history.

(56) References Cited

U.S. PATENT DOCUMENTS

| | | | | |
|---|---|---|---|---|
| 3,491,214 | A | 1/1970 | Rosemond | |
| 3,813,499 | A * | 5/1974 | Vignini | 381/330 |
| 4,965,831 | A | 10/1990 | Schmid | |
| 5,204,917 | A * | 4/1993 | Arndt et al. | 381/324 |
| 6,009,183 | A * | 12/1999 | Taenzer et al. | 381/330 |
| 6,658,125 | B1 | 12/2003 | Batting | |
| 6,748,094 | B1 * | 6/2004 | Tziviskos et al. | 381/330 |
| 6,831,988 | B2 | 12/2004 | Vonlanthen | |
| 2005/0020127 | A1 | 1/2005 | Fickweiler | |

FOREIGN PATENT DOCUMENTS

| | | | |
|---|---|---|---|
| DE | 1122102 | B | 1/1962 |
| EP | 0639932 | A2 | 2/1995 |
| EP | 1443 802 | A2 | 8/2004 |
| WO | WO 00/21334 | | 4/2000 |
| WO | WO 2005/034758 | A1 | 4/2005 |

* cited by examiner

*Primary Examiner*—Brian Ensey
(74) *Attorney, Agent, or Firm*—Sughrue Mion, PLLC

(57) ABSTRACT

Attachment means for attaching a conductor to a hearing aid having a hearing aid housing. The attachment means is adapted to be located partially in said hearing aid housing wall, so as to have a first part located in said hearing aid housing wall and a second part protruding through an aperture in said hearing aid housing wall.

21 Claims, 5 Drawing Sheets

INTERCHANGEABLE ATTACHMENT MEANS FOR ATTACHING A CONDUCTOR TO A HEARING AID

BACKGROUND OF THE INVENTION

The present invention relates to an attachment means for attaching a conductor to a hearing aid, as well as to a hearing aid housing for a BTE hearing aid and an attachment means for attaching a sound conductor.

Behind The Ear hearing aids, or BTE hearing aids for short, normally comprise a housing containing all necessary electronics of the hearing aid including input and output transducers. The output transducer is located in connection with a sound output port in the housing, from which the sound is output to the ear of the user via a sound tube. It should be noted that the output transducer need not be located in immediate connection with the sound output port, but may be located at any appropriate location within the hearing aid housing, the sound being in that case conducted to the output port via an intermediate tube or the like.

The sound tube is often attached indirectly to the hearing aid housing via a replaceable intermediate piece referred to as a hook. Alternatively, the tube may be connected directly to a connecting piece forming part of the hearing aid housing. EP-A-1443802 describes both these alternatives. In EP-A-1443802 the connecting piece to which the sound tube is attached, comprises a thread on which a compression member may be screwed in order to secure the sound tube with respect to the hearing aid housing. Since both the sound tube and the hook, as the case may be, play a role in holding the hearing aid housing in place behind the ear, it is important that they are properly secured to each other. If not, and the two parts detach, there is a major risk of the hearing aid housing falling from its place behind the ear to the ground, with the further risk of it getting ruined or lost.

However, depending on whether a hook or a tube is to be connected to the connecting piece of the hearing aid housing, the connecting piece should have different shapes. The thread used for a securing a hook is not necessarily the best thing for the direct attachment of a tube. In that case a cylindrical piece with a circumferential barb, e.g. at the distal end, might be much more secure and above all convenient.

Making a large number of different hearing aid housings is however not desirable, for reasons of manufacture and storage.

BRIEF SUMMARY OF THE INVENTION

It is the object of the present invention to overcome at least the above problems in the prior art.

According to a first aspect of the present invention, this object is achieved by an attachment means for attaching a conductor to a hearing aid having a hearing aid housing, said attachment means being adapted to be located partially in said hearing aid housing wall, so as to have a first part located in said hearing aid housing wall and a second part protruding through an aperture in said hearing aid housing wall.

By the use of an attachment means the need to manufacture and store a number of different hearing aid housings for different sound conductors is obviated.

According to a second aspect of the present invention the, object is achieved by a hearing aid housing for a BTE hearing aid, said housing comprising a housing wall and an attachment means for attaching a conductor, said attachment means comprising an attachment means located partially in said hearing aid housing wall, so as to have a first part located in said housing wall and a second part protruding through an aperture in said hearing aid housing wall.

According to a third aspect of the invention, the object is achieved by BTE hearing aid comprising a hearing aid housing with a housing wall and an attachment means for attaching a conductor, said attachment means comprising an part having a first and a second part, said second part protruding from said hearing aid housing through an aperture in said housing wall.

According to a preferred embodiment of the invention, said first part comprises means for interlocking with the hearing aid housing in the assembled state. By having means for interlocking with the hearing aid housing, the attachment means according to the invention may be held solely in place by means of said hearing aid housing wall. In particular, this may be achieved by said means for interlocking with said attachment means comprising a recess formed in said housing wall.

According to an alternative preferred embodiment of the invention, said first part comprises means for interlocking with the hearing aid housing and a carrier for electronics in the hearing aid in the assembled state. This not only makes the manufacture of the housing less complicated, but may also improve the acoustic or electric connection between the hearing aid electronics on the carrier and the conductor.

According to a further preferred embodiment according to the invention, said second part is generally cylindrical and comprises a thread. This provides an attachment means suitable for screw connection of a relatively rigid conductor, e.g. in the form of a hook.

According to another embodiment according to the invention, said second part comprises a catch means. This provides an attachment means, which may inter alia be suitable for the attachment of a relatively soft conductor such as a sound tube.

According to a preferred embodiment of the invention, said catch means comprises a barb, in particular a circumferential barb. Such a barb is simple to manufacture, yet still an efficient means to retain e.g. a sound tube.

Preferably said barb is located at the distal end of said second part. This facilitates the attachment of the sound tube on attachment means.

According to a further preferred embodiment of the invention, there is provided a locking means for securing a tube retained by the barb, said locking means comprises an annular member adapted to be placed around said tube at a location registering with said barb. In this way the sound tube may be held even more securely on said barb.

Preferably, said annular member comprises at least one internal recess adapted to register with said barb, and more preferably said internal recess is a circumferential groove. The latter allows the mounting of the locking means at any angle of rotation with respect to the attachment member, so that no angular positioning is necessary.

BRIEF DESCRIPTION OF THE SEVERAL VIEWS OF THE DRAWING

Non-limiting examples of the invention will now be explained below with reference to the schematical drawings, in which.

DETAILED DESCRIPTION OF THE INVENTION

Figure 9:
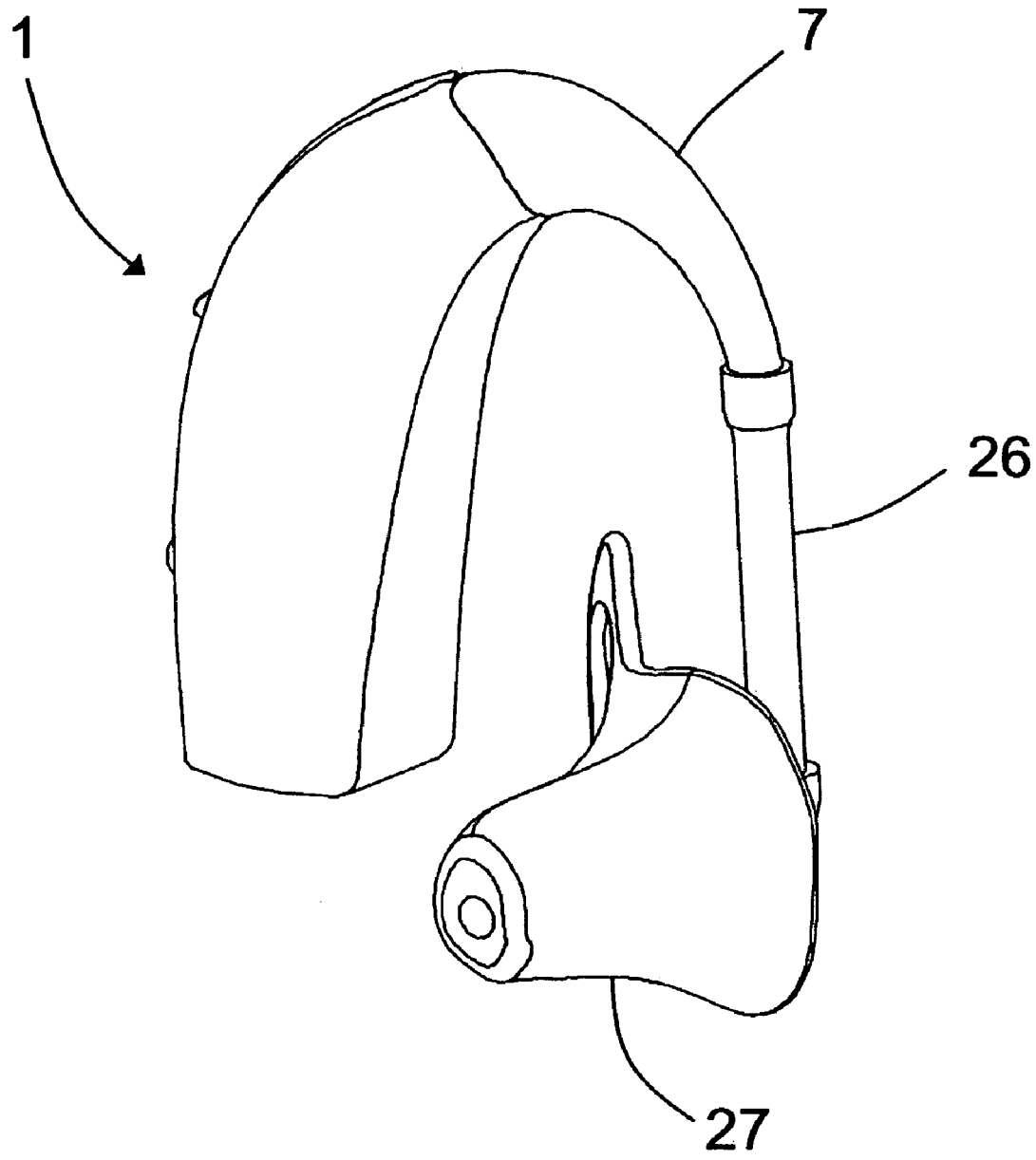
FIG. 9 shows a complete hearing aid with a hook attached using an attachment means according to the invention.

In all the figures except FIG. 9, the parts of the hearing aid housing which are not relevant for the attachment means have been omitted, so as to focus on the end where the attachment means is located.

Figure 1:
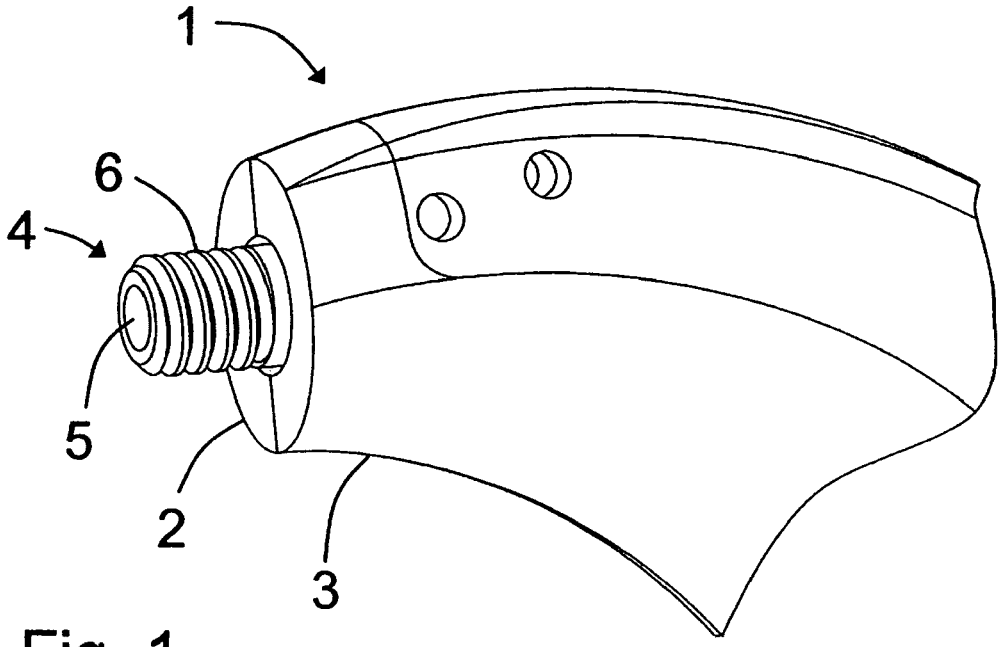
FIG. 1 shows a partial view of a first embodiment of a hearing aid comprising an attachment means according to the invention.
Figure 2:
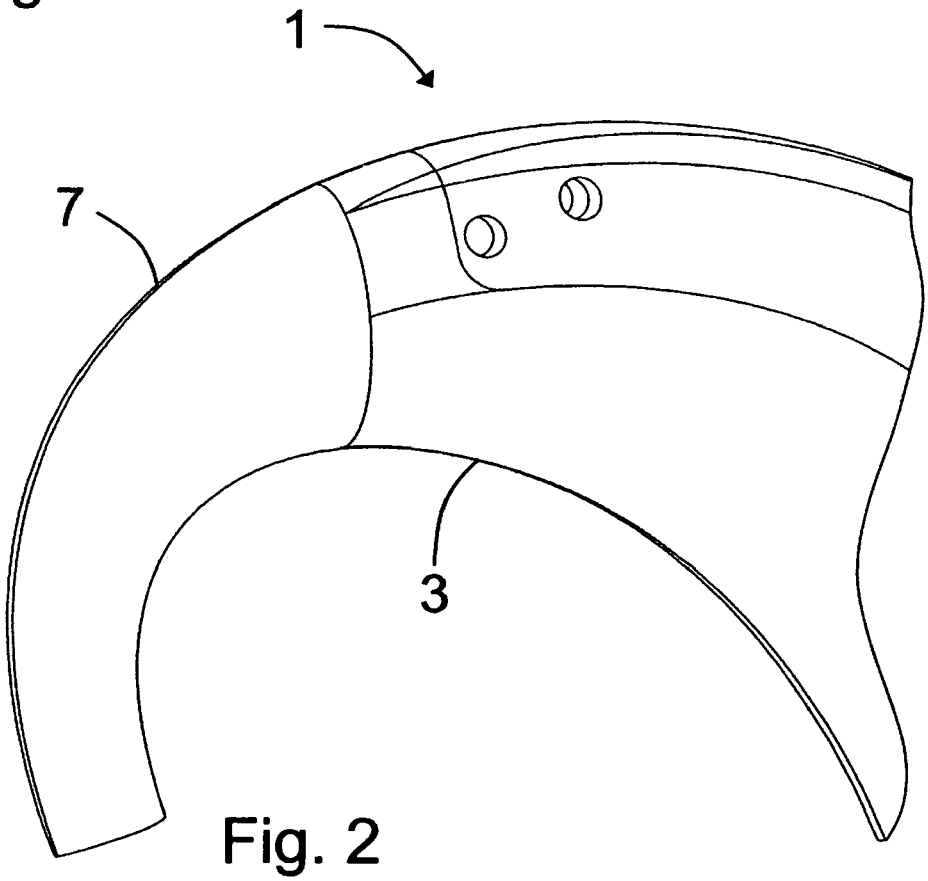
FIG. 2 shows a partial view of the hearing aid of FIG. 1 with a hook attached.

Referring first to FIG. 1, there is illustrated a hearing aid housing 1. The hearing aid housing 1 comprises two shell-shaped halves 2 and 3, between which the inner cavity of the hearing aid is formed. Through an aperture in an end surface formed by the two halves an attachment means 4 according to the invention protrudes. In the illustrated embodiment, the attachment means 4 is generally cylindrical with a through bore 5 and an external thread 6. The external thread may serve as an attachment means for a sound conductor in the form of a hook 7, which by means of an internal mating thread may be screwed onto the attachment means 4, as illustrated in FIG. 2.

Figure 3:
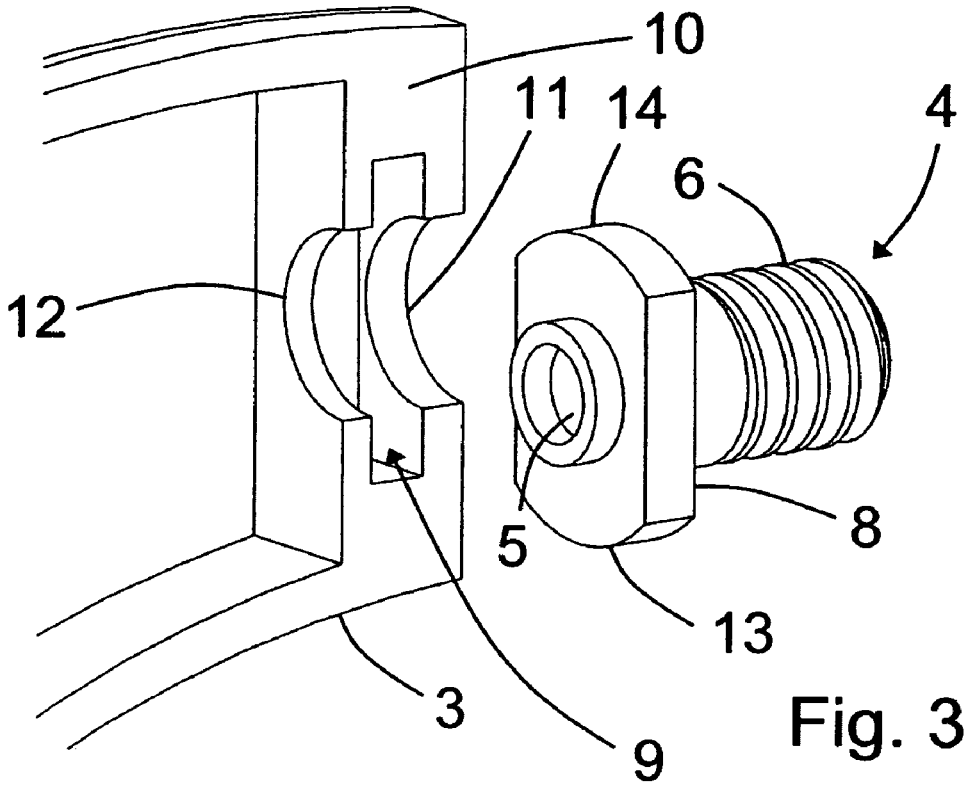
FIG. 3 shows a partially exploded view of the hearing aid of FIG. 1.

In FIG. 3 an exploded view of one shell shaped half 3 of the hearing aid housing 1 and the attachment means 4, constituting a separate interchangeable element, is shown. The other shell shaped half 2 is not shown, but the skilled person will understand that, at least as far as the illustrated features are concerned, the shell shaped half 2 is a mirror image of the shell shaped half 3.

Figure 4:
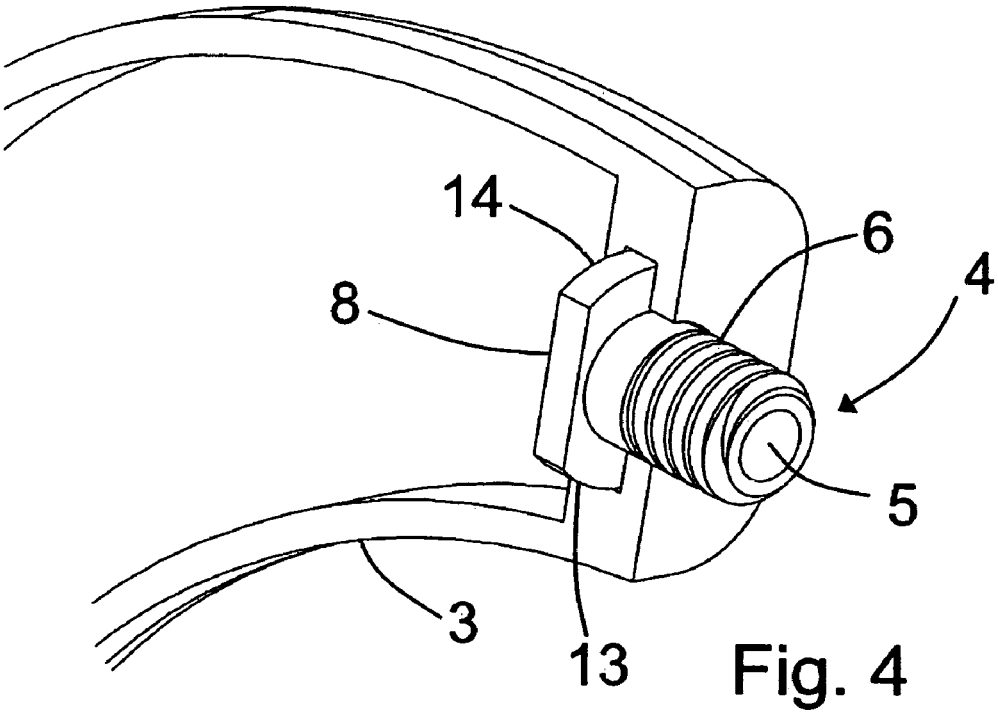
FIG. 4 shows a partially assembled view of the hearing aid of FIG. 1.

The interchangeable attachment means 4 is provided with a flange 8. The flange 8 is adapted to fit in a recess 9 provided in the end wall 10 of the hearing aid housing 1, i.e. in the wall of each shell shaped half 2, 3, as can be seen in FIG. 4. Together with two semicircular cutouts 11, 12 in the end wall 10, the recess 9 forms part of an aperture in said end wall 10. In the preferred embodiment, the flange 8 has a generally rectangular shape, with rounded ends 13, 14 in order to facilitate insertion in the recess 9. When the housing 1 is assembled with the flange 8 placed in the recess 9, the attachment means 4 is located partially in said end wall 10. The flange 8 and the recess 9 interlock and secure the attachment means 4 against rotation relatively to the housing 1 when e.g. a hook 7 is screwed onto the thread 6 of the part protruding from the housing 1. The skilled person would understand that a number of other shapes of the flange 8 and the recess 9 could be used to secure the attachment means 4 against rotation. Also, the flange 8 and the recess 9 secure the attachment part 4 against linear motion with respect to the housing 1, i.e. in the direction of the bore 5 of the attachment part 4. This is in particular important when the interchangeable attachment means 4 according to a different embodiment to be described below is adapted for linear attachment of e.g. a sound tube.

Figure 5:
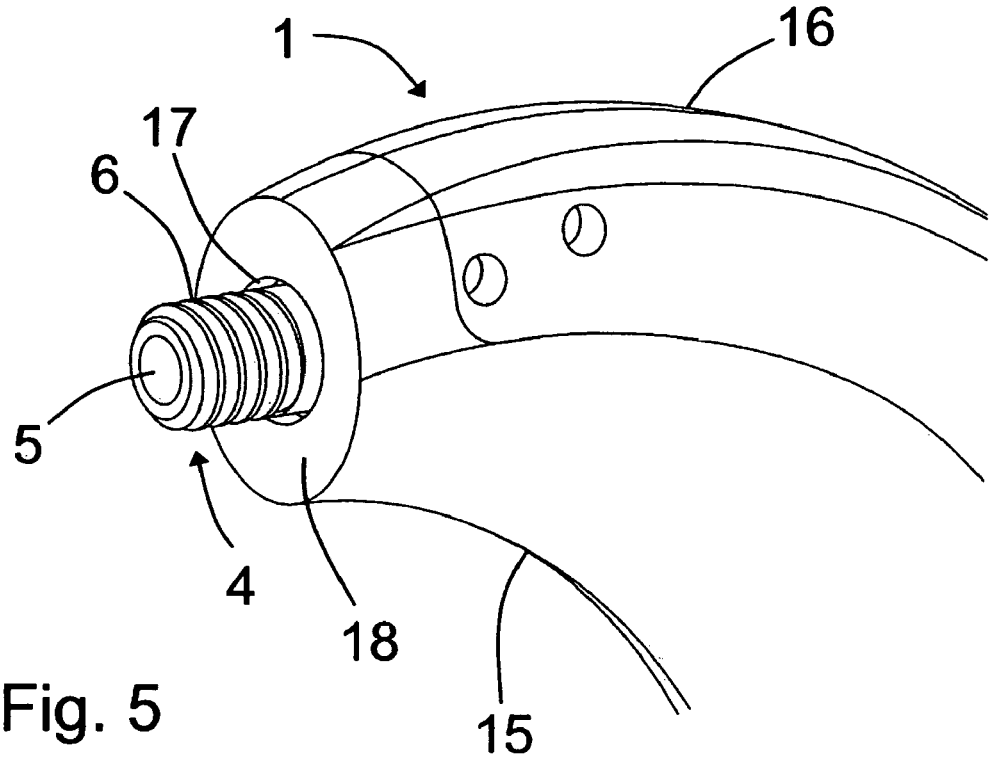
FIG. 5 shows a partial view of a second embodiment of a hearing aid comprising an attachment means according to the invention

Turning now to FIG. 5, another embodiment of the interchangeable attachment means 4 adapted to a different hearing aid housing 1 is illustrated. The hearing aid housing 1 comprises two parts, a main housing part 15 and a lid part 16. In FIG. 5 the attachment means 4 is located partially in an aperture 17 in the end wall 18 of the hearing aid housing 1.

Figure 6:
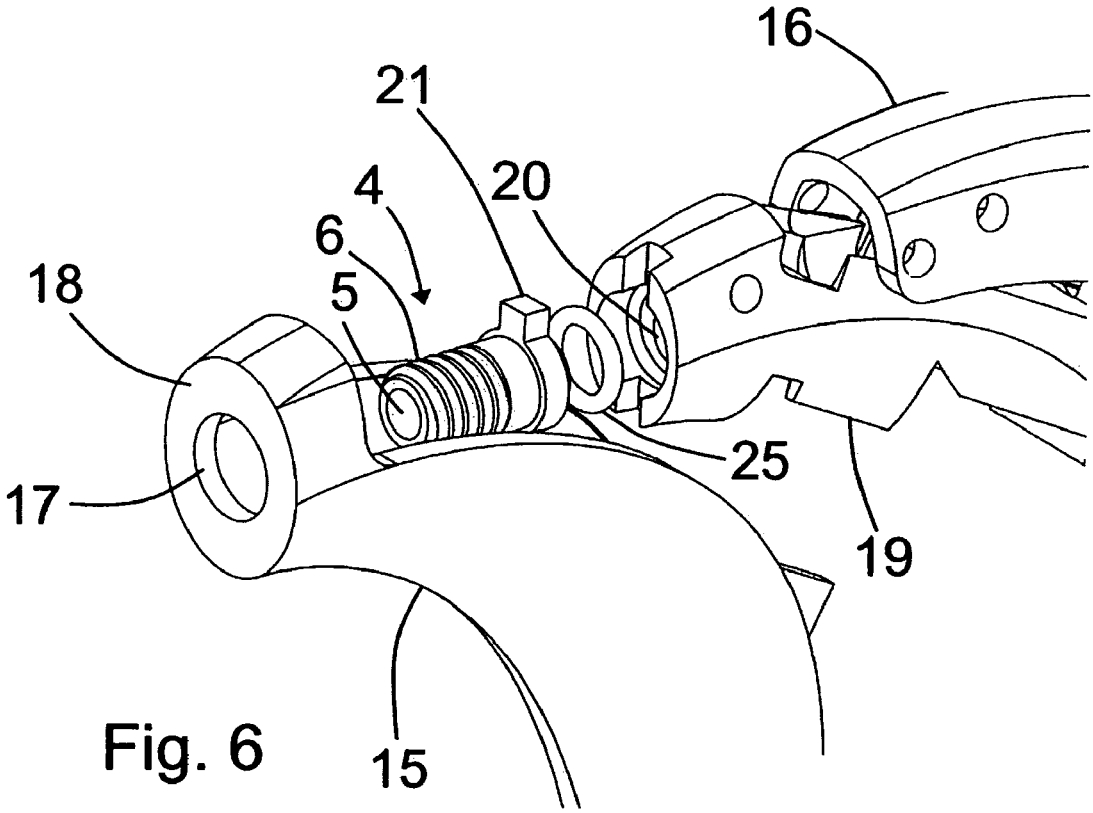
FIG. 6 shows a partially exploded view of the hearing aid of FIG. 5.

As can best be seen from the exploded view of FIG. 6, the generally cylindrical part of the attachment means 4 protrudes from the aperture 17 in the end wall 18, so as to allow attachment of a conductor, e.g. a hook, as already explained in conjunction with FIGS. 1 to 4.

The interchangeable attachment means 4 is held in place in the aperture 17 by means of a carrier part 19 of the hearing aid, carrying an output transducer 20 and preferably all or parts of the electronics of the hearing aid. The interchangeable attachment part 4 comprises a number of radial protrusions 21. When the hearing aid is assembled, the carrier part 19 within the hearing aid housing 1, presses the radial protrusions 21 of the attachment part 4 against the internal side of the end wall 18, thereby securing the attachment part 4 against linear motion. In order to also secure the attachment part 4 against rotation with respect to the hearing aid housing 1, the carrier part 19 has a number of cut outs matching the protrusions 21. In this respect, it should be noted that with appropriate choice of the width of the cut outs, a flange plate corresponding to or even identical to that of FIGS. 3 and 4 could be used instead of the protrusions 21.

Preferably a sealing ring 25 is interposed between the attachment part 4 and the carrier part 19, so as to seal the sound path from the transducer to the through bore 5 of the interchangeable attachment means 4.

Figure 7:
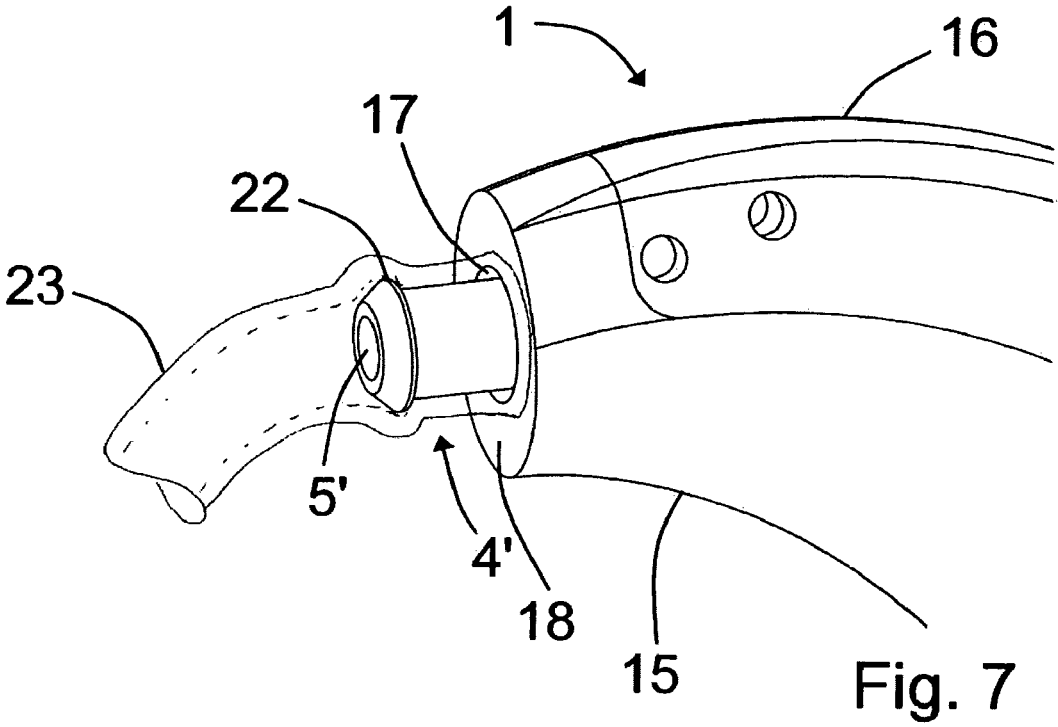
FIG. 7 shows a partial view of the hearing aid of FIG. 5 provided with an alternative attachment means according to the invention, on which an attached sound tube is indicated.

FIG. 7 illustrates the hearing aid of FIG. 5 where the threaded interchangeable attachment means 4 has been substituted with an alternative embodiment of the interchangeable attachment means 4'.

The interchangeable attachment means 4' of FIG. 7 differs from the interchangeable attachment means 4 of FIG. 5 in that the generally cylindrical part protruding from the aperture 17 in the end wall 18 is not threaded. Instead it is generally smooth, but provided with a catch means. In the illustrated embodiment, the catch means is a circumferential barb 22 arranged at the end. The skilled person will realise that a single circumferential barb 22 is only a preferred embodiment and that various other catch means could be used. In particular the barb 22 need not be circumferential. Also, there could be several barbs, circumferential or not.

Unlike the interchangeable attachment means 4 having a thread 6, which is suitable for attaching e.g. a hook 7, the interchangeable attachment means 4' is suitable for the direct attachment of a sound tube 23 as indicated in FIG. 7. Direct attachment of the sound tube 23 is here to be understood opposed to attachment of the sound tube to the hearing aid 1 via the hook 7, as illustrated in FIG. 9, where a sound tube 26 leading to an earplug 27 is attached to the distal end of the hook 7. When a sound tube 23 is slid over the cylindrical part of the interchangeable attachment part 4 it will be retained securely by the circumferential barb 22.

Thus, without modification of the hearing aid housing 1 as such, the hearing aid may adapted to the use with either a hook 7 or a sound tube 23, simply by substituting the attachment means 4 for the attachment means 4' or vice versa, or by appropriate selection, when assembling the hearing aid.

In respect of the interchangeable attachment part 4', it should be noted that the protruding part need not necessarily be a straight cylindrical part, but could instead have a curvature.

Figure 8:
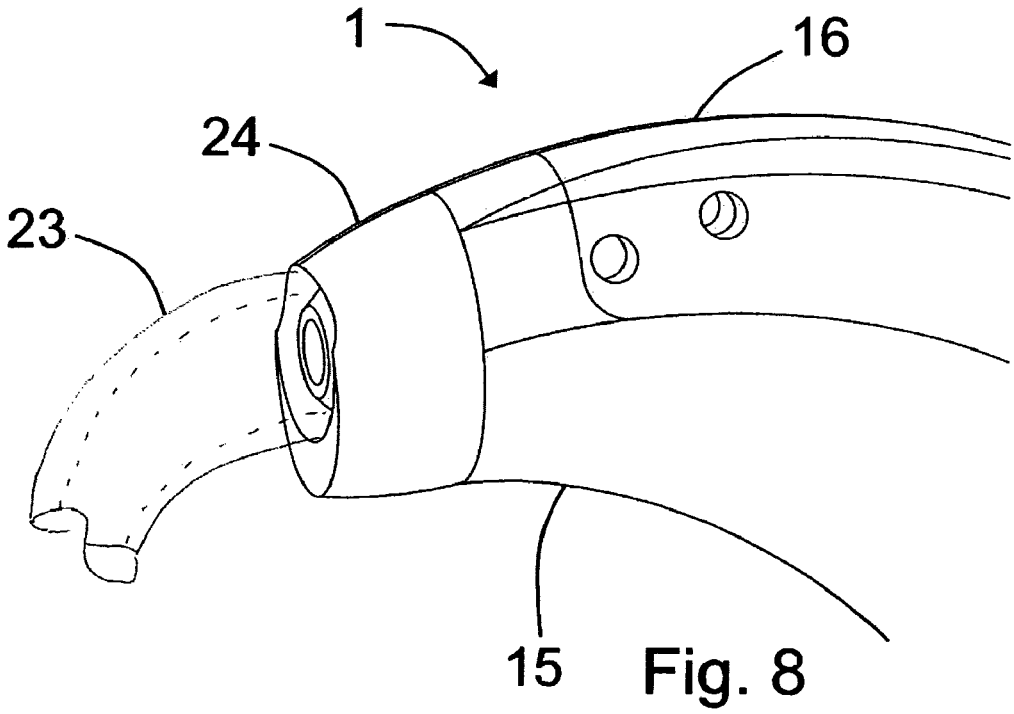
FIG. 8 shows a partial view of the hearing aid corresponding to that of FIG. 7, but provided with a further securing means for the attached sound tube.

Though the circumferential barb 22 should normally be sufficient to retain the sound tube 23, it may be desirable to secure it further. For this purpose a locking means 24 may be provided as illustrated in FIG. 8. The locking means 24 illustrated in FIG. 8 comprises an annular member placed around the sound tube 23 at a location registering with the circumferential barb 22.

Preferably the annular member comprises at least one internal recess (not visible) registering with the barb. In particular the internal recess is a circumferential groove, so as to match the circumferential barb 22.

Though the above description has been exemplified using sound conductors such as the tube 23 and the hook 7, it should be noticed that the invention is not restricted thereto. In particular the interchangeable attachment means could also be adapted to the attachment of electrical conductors, or combined conductors for sound and electricity, such as sound tubes with embedded electrical wires.

The invention claimed is:

1. An attachment structure for attaching a conductor to a hearing aid having a hearing aid housing with a hearing aid housing wall, said attachment structure defining a sound conduit and being adapted to be located partially in said hearing aid housing wall, so as to have a first part located in said hearing aid housing wall and a second part protruding through an aperture in said hearing aid housing wall, said first part having means for an interlocking structure which interlocks with the hearing aid housing in an assembled state of said hearing aid housing.

2. Attachment structure according to claim 1, wherein said first part comprises structure for interlocking with the hearing aid housing and with a carrier for electronics in the hearing aid in an assembled state thereof.

3. Attachment structure according to claim 1, wherein said second part is generally cylindrical and comprises a thread.

4. Attachment structure according to claim 1, wherein said second part comprises a catch element.

5. Attachment structure according to claim 4, wherein said catch element comprises a barb.

6. Attachment structure according to claim 5, wherein said barb is circumferential.

7. A hearing aid housing for a BTE hearing aid, said housing comprising a housing wall and an attachment structure for attaching a conductor, said attachment structure defining a sound conduit and being located partially in said hearing aid housing wall, so as to have a first part located in said housing wall and a second part protruding through an aperture in said hearing aid housing wall, said attachment structure having interlocking structure for interlocking with the hearing aid housing in an assembled state said hearing aid housing.

8. A hearing aid housing according to claim 7, wherein said hearing aid housing wall comprises structure for interlocking with said attachment structure.

9. A hearing aid housing according to claim 7, wherein said structure for interlocking with said attachment structure comprises a recess formed in said housing wall.

10. A hearing aid housing according to claim 7, wherein said attachment structure comprises structure for interlocking with a carrier for electronics in the hearing aid.

11. A BTE hearing aid comprising a hearing aid housing with a housing wall and an attachment structure for attaching a conductor, said attachment structure comprising an interchangeable part which can be removed without removing an electrical components of said hearing aid, said interchangeable part having a first and a second part, said second part protruding from said hearing aid housing through an aperture in said housing wall, said interchangeable part having a through bore.

12. A BTE hearing aid according to claim 11, wherein said hearing aid and said attachment structure comprise mutually interlocking structures.

13. A BTE hearing aid according to claim 12, wherein said second part of said interchangeable part comprises a generally cylindrical surface with an external thread.

14. A BTE hearing aid according to claim 12, wherein said second part of said interchangeable part comprises a generally cylindrical surface with at least one catch element.

15. A BTE hearing aid according to claim 13, wherein said catch element comprises a barb.

16. A BTE hearing aid according to claim 15, wherein said barb is a circumferential barb.

17. A BTE hearing aid according to claim 15, wherein said barb is located at the distal end of said second part.

18. A hearing aid having a hearing aid housing with a hearing aid housing wall, a conductor, and attachment structure for attaching the conductor to the hearing aid, said attachment structure defining a sound conduit and being located partially in said hearing aid housing wall so as to have a first part located in said hearing aid housing wall and a second part protruding through an aperture in said hearing aid housing wall, said first part having interlocking structure for interlocking with the hearing aid housing in an assembled state of the hearing aid housing.

19. Attachment structure for attaching a conductor to a hearing aid having a hearing aid housing with a hearing aid housing wall, said attachment structure defining a sound conduit and having first part located inside of said hearing aid housing and a second part protruding through an aperture in said hearing aid housing wall, said first part having interlocking structure for securing said attachment structure such that it will not rotate with respect to said hearing aid housing, said attachment structure being removable from said hearing aid housing without removing any electrical components of said hearing aid.

20. A hearing aid housing for a BTE hearing aid, said housing comprising a housing wall and an attachment structure for attaching a conductor, said attachment structure defining a sound conduit and having a first part located in said hearing aid housing and a second part protruding through an aperture in said hearing aid housing wall, said attachment structure having interlocking structure for securing said attachment structure such that it will not rotate with respect to said hearing aid housing in an assembled state of said hearing aid housing, said attachment structure being removable from said hearing aid housing without removing any electrical components of said hearing aid.

21. A hearing aid having a hearing aid housing with a hearing aid housing wall, a conductor, and attachment structure for attaching the conductor to the hearing aid, said attachment structure defining a sound conduit and having a first part located in said hearing aid housing wall and a second part protruding through an aperture in said hearing aid housing wall, said first part having interlocking structure for securing said attachment structure such that it will not rotate with respect to said hearing aid housing in an assembled state of said hearing aid housing, said attachment structure being removable from said hearing aid housing without removing any electrical components of said hearing aid.

* * * * *